US009240302B2

(12) United States Patent
Lidstrom

(10) Patent No.: US 9,240,302 B2
(45) Date of Patent: Jan. 19, 2016

(54) LAMP

(75) Inventor: Kjell Lidstrom, Burea (SE)

(73) Assignee: Ceravision Limited, Milton Keynes (GB)

( * ) Notice: Subject to any disclaimer, the term of this patent is extended or adjusted under 35 U.S.C. 154(b) by 260 days.

(21) Appl. No.: 13/809,612

(22) PCT Filed: Jul. 12, 2011

(86) PCT No.: PCT/GB2011/001049

§ 371 (c)(1),
(2), (4) Date: Jan. 11, 2013

(87) PCT Pub. No.: WO2012/007714

PCT Pub. Date: Jan. 19, 2012

(65) Prior Publication Data

US 2013/0106282 A1 May 2, 2013

(30) Foreign Application Priority Data

Jul. 13, 2010 (GB) ..... 1011793.5

(51) Int. Cl.

| | |
|---|---|
| ***H01J 25/50*** | (2006.01) |
| ***H01J 65/04*** | (2006.01) |
| ***H05B 41/24*** | (2006.01) |
| ***H05H 1/46*** | (2006.01) |

(52) U.S. Cl.

CPC ..... *H01J 25/50* (2013.01); *H01J 65/044* (2013.01); *H05B 41/24* (2013.01); *H05H 1/46* (2013.01)

(58) Field of Classification Search

CPC ..... H01J 25/50; H01J 25/587; H01J 65/044; H05B 41/24; H05H 1/46

USPC ..... 315/39, 39.51, 111.21, 216, 276–283

See application file for complete search history.

(56) References Cited

U.S. PATENT DOCUMENTS

| | | | | |
|---|---|---|---|---|
| 5,886,480 | A | 3/1999 | Penzenstadler | |
| 8,907,564 | B2 * | 12/2014 | Borsuk et al. | 315/39.51 |
| 2009/0284166 | A1 | 11/2009 | Devincentis | |

* cited by examiner

*Primary Examiner* — Hai L Nguyen
(74) *Attorney, Agent, or Firm* — Bay State IP, LLC

(57) ABSTRACT

To the common point (C) of two transistors of a magnetron, switched converter power circuit is connected a coupling capacitor which provides input to a starter circuit. A transistor switch id in series with a capacitor and a diode. When the switch is off no current flows in (D11). When the switch is made, (D11) conducts during alternate halves of cycles present a (C). A second diode also conducts and allows current to pass through discharge capacitor. This progressively charges until the voltage across it reaches the breakdown voltage of a gas discharge tube (GTD). Whereupon the capacitor discharges through the primary winding of transformer (TR2). The second winding has many more turns and a started voltage is induced in the starter electrode. This is isolated from the Faraday cage and terminates adjacent to the crucible, close to the void.

6 Claims, 3 Drawing Sheets

LAMP

CROSS REFERENCE TO RELATED APPLICATION

This application is for entry into the U.S. National Phase under §371 for International Application No. PCT/GB2011/001049 having an international filing date of Jul. 12, 2011, and from which priority is claimed under all applicable sections of Title 35 of the United States Code including, but not limited to, Sections 120, 363, and 365(c), and which in turn claims priority under 35 USC 119 to United Kingdom Patent Application No. 1011793.5 filed on Jul. 13, 2010.

BACKGROUND OF THE INVENTION

1. Field of the Invention

The present invention relates to a lamp, incorporating a magnetron powered light source.

2. Description of the Related Art

In European Patent No EP1307899, granted in our name there is claimed a light source a waveguide configured to be connected to an energy source and for receiving electromagnetic energy, and a bulb coupled to the waveguide and containing a gas-fill that emits light when receiving the electromagnetic energy from the waveguide, characterised in that:

(a) the waveguide comprises a body consisting essentially of a dielectric material having a dielectric constant greater than 2, a loss tangent less than 0.01, and a DC breakdown threshold greater than 200 kilovolts/inch, 1 inch being 2.54 cm, (b) the wave guide is of a size and shape capable of supporting at least one electric field maximum within the wave guide body at at least one operating frequency within the range of 0.5 to 30 GHz, (c) a cavity depends from a first side of the waveguide, (d) the bulb is positioned in the cavity at a location where there is an electric field maximum during operation, the gas-fill forming a light emitting plasma when receiving microwave energy from the resonating waveguide body, and (e) a microwave feed positioned within the waveguide body is adapted to receive microwave energy from the energy source and is in intimate contact with the waveguide body.

In our International Application No PCT/GB2010/000911, applied for on 6$^{th}$ May 2010, ("Our 1$^{st}$ Light Source and Starter Application") we have described and claimed a light source to be powered by microwave energy, the source having:

- a solid plasma crucible of material which is lucent for exit of light therefrom, the plasma crucible having a closed void in the plasma crucible,
- a Faraday cage surrounding the plasma crucible, the cage being at least partially light transmitting for light exit from the plasma crucible, whilst being microwave enclosing,
- a fill in the closed void of material excitable by microwave energy to form a light emitting plasma therein, and
- an antenna arranged within the plasma crucible for transmitting plasma-inducing microwave energy to the fill, the antenna having:
  - a connection extending outside the plasma crucible for coupling to a source of microwave energy;

the light source also including:

- a controllable source of microwaves coupled to the antenna connection;
- a starter for starting a plasma in the fill in the closed void,

- a detector for detecting starting of the plasma and
- a control circuit for powering the source at low power initially and simultaneously with the starter and switching off the starter and increasing power of the microwave source after detection of starting of the plasma.

In Our 1$^{st}$ Light Source and Starter Application and in the present application, we use the following definitions:

- "microwave" is not intended to refer to a precise frequency range. We use "microwave" to mean the three order of magnitude range from around 300 MHz to around 300 GHz;
- "lucent" means that the material, of which an item described as lucent is comprised, is transparent or translucent;
- "plasma crucible" means a closed body enclosing a plasma, the latter being in the void when the void's fill is excited by microwave energy from the antenna;
- "Faraday cage" means an electrically conductive enclosure of electromagnetic radiation, which is at least substantially impermeable to electromagnetic waves at the operating, i.e. microwave, frequencies.

EP1307899 and Our 1$^{St}$ Light Source and Starter Application have in common that they are in respect of:

A microwave plasma light source having:

- a Faraday cage delimiting a waveguide;
- a body of solid-dielectric material at least substantially embodying the waveguide within the Faraday cage;
- a closed void in the waveguide containing microwave excitable material; and
- provision for introducing plasma exciting microwaves into the waveguide;
- the arrangement being such that on introduction of microwaves of a determined frequency a plasma is established in the void and light is emitted.

Such a light source is referred to herein as a "Microwave Plasma Light Source" or MPLS.

We also refer below to the Microwave Plasma Light Source of Our 1$^{st}$ Light Source and Starter Application as a Light Emitting Resonator or LER.

In our International Application No PCT/GB2011/000920, filed on 17$^{th}$ Jun. 2011 ("Our Magnetron Power Supply Application"), we have described and claimed a power supply for a magnetron comprising:

- a DC voltage source;
- a converter for raising the output voltage of the DC voltage source, the converter having:
  - a capacitative-inductive resonant circuit,
  - a switching circuit adapted to drive the resonant circuit at a variable frequency above the resonant frequency of the resonant circuit, the variable frequency being controlled by a control signal input to provide an alternating voltage,
  - a transformer connected to the resonant circuit for raising the alternating voltage,
  - a rectifier for rectifying the raised alternating voltage to a raised DC voltage for application to the magnetron;
  - means for measuring the current from the DC voltage source passing through the converter;
  - a microprocessor programmed to produce a control signal indicative of a desired output power of the magnetron; and
  - an integrated circuit arranged in a feed back loop and adapted to apply a control signal to the converter switching circuit in accordance with a comparison of a signal from the current measuring means with the signal from the microprocessor for controlling the power of the magnetron to the desired power.

This power supply (i.e. the one of Our Magnetron Power Supply Application) is an improvement on an earlier power supply utilising a differently arranged operational amplifier and a differently arranged microprocessor.

Again in this application, we use the further additional definition: "Magnetron, Switched Converter Power Circuit" or MSCPC means the following components of the power supply:

- the converter adapted to be driven by a DC voltage source and produce an alternating current output, the converter having:
  - the resonant circuit including an inductance and a capacitance ("LC circuit") exhibiting a resonant frequency and
  - the switching circuit adapted to switch the inductance and the capacitance to generate a switched alternating current having a frequency greater than that of the resonance of the LC circuit;
- the output transformer for increasing the voltage of the output alternating current; and
- the rectifier and smoothing circuit connected to the secondary circuit of the output transformer for supplying increased voltage to the magnetron;

SUMMARY OF THE INVENTION

The object of the present invention is to provide an improved lamp utilising a MSCPC and a starter improved from that disclosed in Our 1st Light Source and Starter Application.

According to the invention there is provided a magnetron powered lamp, the lamp comprising:

- a Microwave Plasma Light Source;
- a magnetron arranged to power the MPLS;
- a Magnetron, Switched Converter Power Circuit arranged to power the magnetron;
- a microprocessor arranged to control the MSCPC;
- a starter for starting a plasma in the fill in the closed void of the MPLS, the starter comprising:
  - a starter electrode arranged to apply starter voltage to the closed void,
  - a starter circuit including:
    - a capacitor,
    - means for selectively charging the capacitor from a switched point in the MSCPC,
    - means for discharging the capacitor,
    - a transformer having:
      - a primary winding arranged to receive discharge current from the capacitor and
      - a secondary winding arranged to generate the starter voltage, the secondary winding being connected to the starter electrode for application of starter voltage to the closed void and
  - a detector for detecting starting of the plasma;

wherein:

- the microprocessor is arranged to select charging of the capacitor for starting of the plasma until the detector detect that the plasma has started.

Whilst it is envisaged that the selective charging means could be an electronic switch normally isolating the discharging means from the switched point of the power circuit, in the preferred embodiment, the selective charging means is a electronic switch normally grounding the discharging means. In either instance, the state of the switch is changed for starter operation.

Also in the preferred embodiment, the means for discharging the capacitor is a gas discharge unit. Alternatively trigger diode could be employed.

Further in the preferred embodiment, the microprocessor controls the MSCPC via an integrated circuit arranged in a feed back loop and adapted to apply a control signal to the converter switching circuit in accordance with a comparison of a signal from means for measuring MSCPC with a signal from the microprocessor for controlling the power of the magnetron to a desired power.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE PREFERRED EMBODIMENTS

Figure 1:
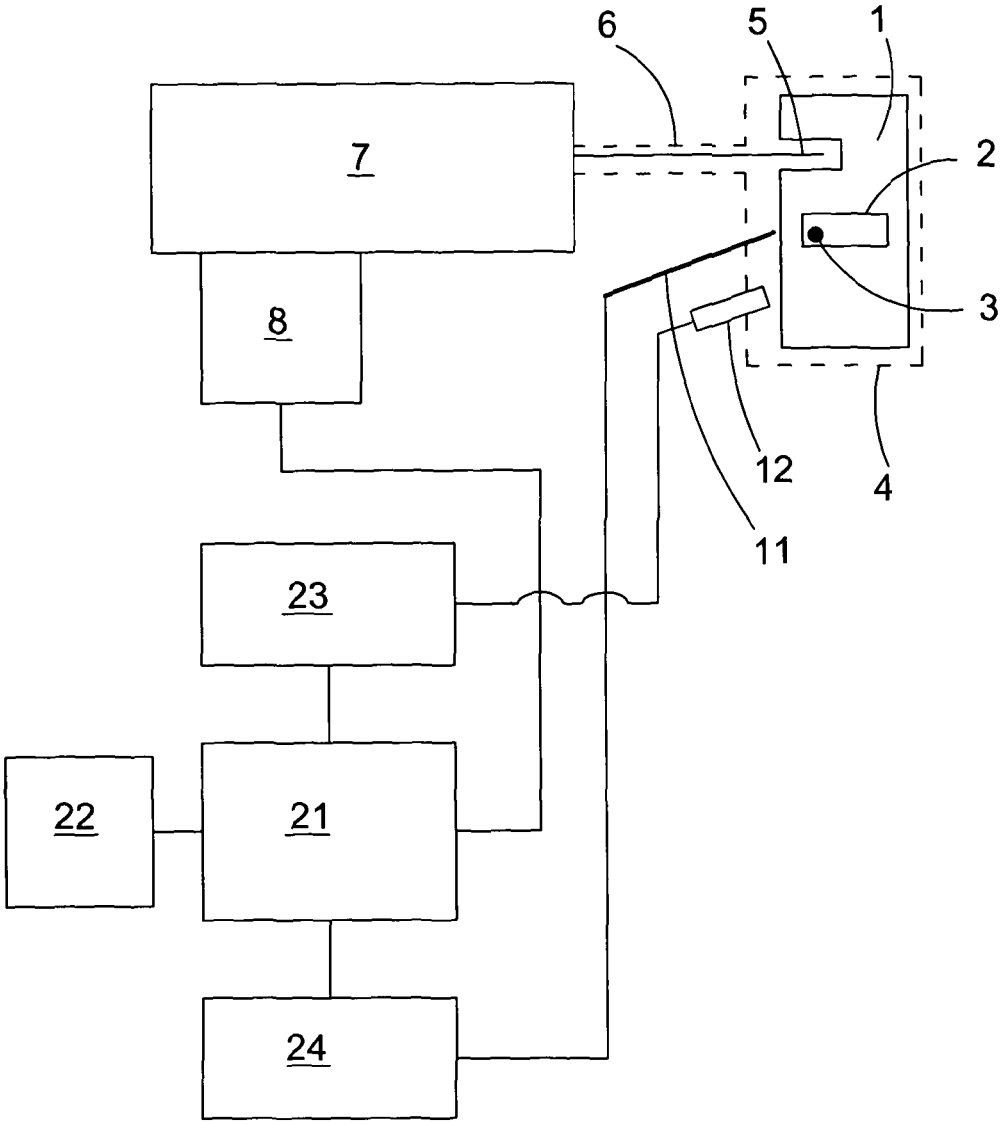
FIG. 1 is a block diagram of a magnetron powered lamp of the invention.

Referring to FIG. 1, the LER lamp is shown diagrammatically as having a quartz crucible 1 with a central closed void 2 containing material 3 excitable by microwaves as a plasma. The crucible is enclosed in a Faraday cage 4 defining a waveguide, in which microwaves resonate in operation of the lamp. An antenna 5, having a coaxial connection 6 extending from a matching circuit wave guide 7, passes into the crucible adjacent to the fill. Remote from the crucible a magnetron 8 is arranged to transmit microwaves into the wave guide for onwards transmission to the crucible.

Extending close to the end of the void is a starter electrode 11 and adjacent to this is mounted a photodiode 12 for detecting whether the plasma has been lit and is emitting light.

Figure 2:
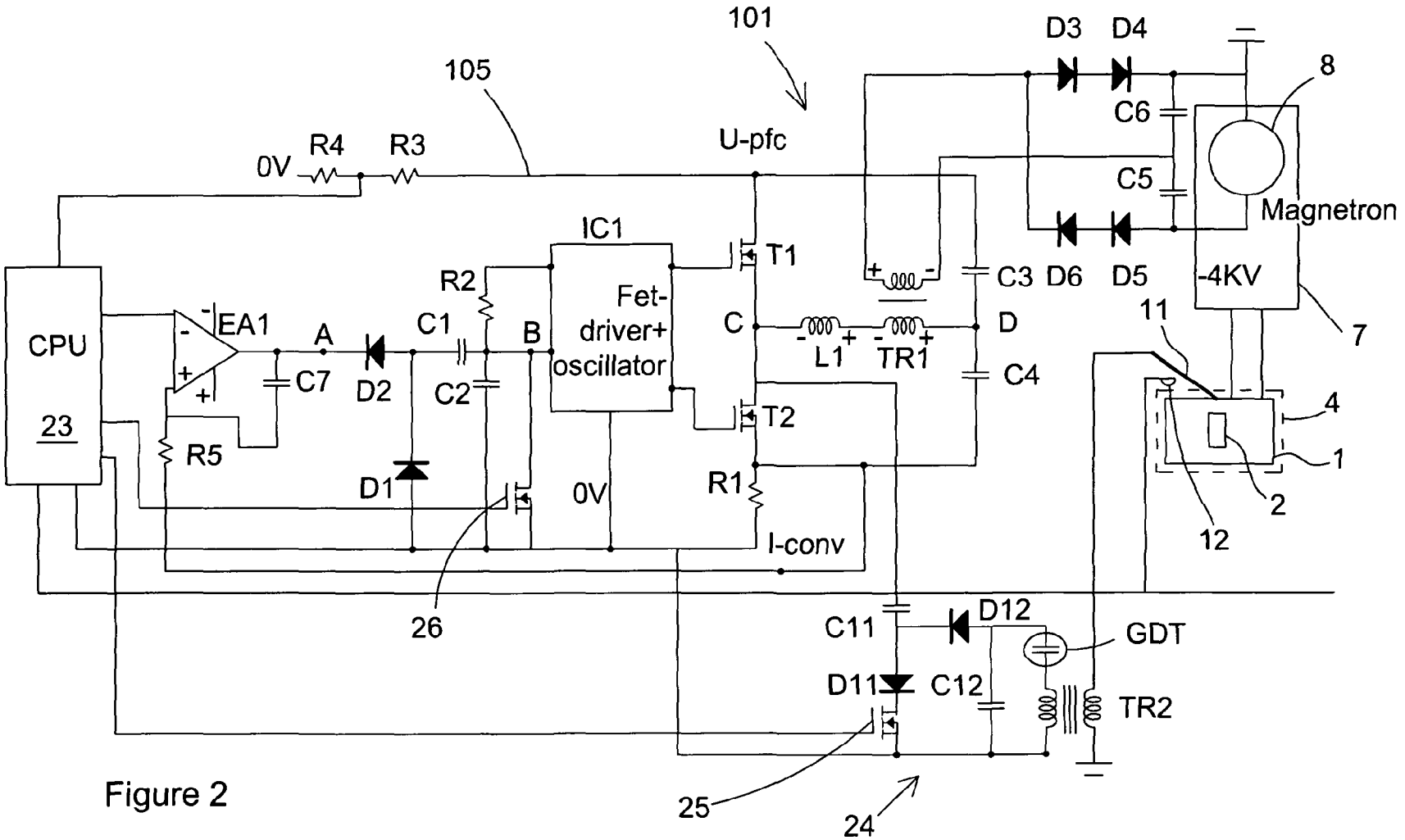
FIG. 2 is a more detailed circuit diagram of a Magnetron, Switched Converter Power Circuit similar to that described in Our Magnetron Power Supply Application and incorporating a starter of this invention.

A power supply 21 for the magnetron 8 is connected to a voltage source 22 and a microprocessor 23. As shown in FIG. 2, the power supply comprises a quasi-resonant converter 101 having MOSFET field effect switching transistors T1,T2. These are switched by an integrated circuit IC1. An inductance L1 and primary coil of a transformer TR1 are connected in series to the common point C of the transistors and capacitors C3,C4 connected beyond the primary coil back to the remote contact of the transistors. The inductances and the capacitors have a resonant frequency, above which the converter is operated, whereby it appears to be primarily an inductive circuit as regards the down-stream magnetron circuit. This comprises four half bridge diodes D3,D4,D5,D6 and smoothing capacitors C5,C6, connected to the secondary winding of the transformer and providing DC current to the magnetron 8. The windings ratio of the transformer is 10:1, whereby voltage of the order of 4000 volts is applied to the magnetron, the augmented mains DC voltage on line 105 being 400 volts (at least in Europe).

To the common point C of the transistors is connected a coupling capacitor C11 which provides input to a starter circuit 24. A transistor switch 25 is in series with the capacitor C11 and a diode D1. When the switch is off no current flows in D11. When the switch is made, D11 conducts during alternate halves of cycles present at C. A second diode D12 also conducts and allows current to pass through discharge capacitor C12. This progressively charges until the voltage across it reaches the breakdown voltage of a gas discharge tube GTD. Whereupon the capacitor discharges through the primary winding of transformer TR2. The secondary winding has many more turns and a starter voltage is induced in the starter electrode 11. This is isolated from the Faraday cage 4 and terminates adjacent the crucible, close to the void 2.

Every time the discharge capacitor discharges, the void is pulsed. The magnetron is being driven—the starter being able to operate only as a result of the converter operating. Once a plasma in the void establishes, this is detected by a photodiode 12 adjacent the starter electrode 11. Presence of plasma is signalled to the microprocessor which opens the transistor switch 25.

For completeness, a current measurement resistor R1, an operational amplifier EA1 and associated components are shown for operation of the converter in accordance with Our Magnetron Power Supply Application. A further transistor switch 26 is also shown. With this the microprocessor can immediately close down the power supply, either under human control or automatically, for instance in the event of the magnetron current exceeding a limit such as when its magnets degrade.

In practical operation, with the lamp not on, the voltage source (not shown above) and the microprocessor are switched on. The microprocessor is instructed to power up the lamp in accordance with one or more protocols. The microprocessor controls the power supply to apply a low power to the magnetron and the starter to apply a starter pulse stream of a determined duration to the starter. If the plasma does not start, the pulse stream is repeated after a delay. The process is repeated until the plasma lights. Should this fails the operator is alerted. Once the plasma has lit, power to the magnetron is increased to a desired level, commensurate with desired light output from the plasma crucible.

Figure 3:
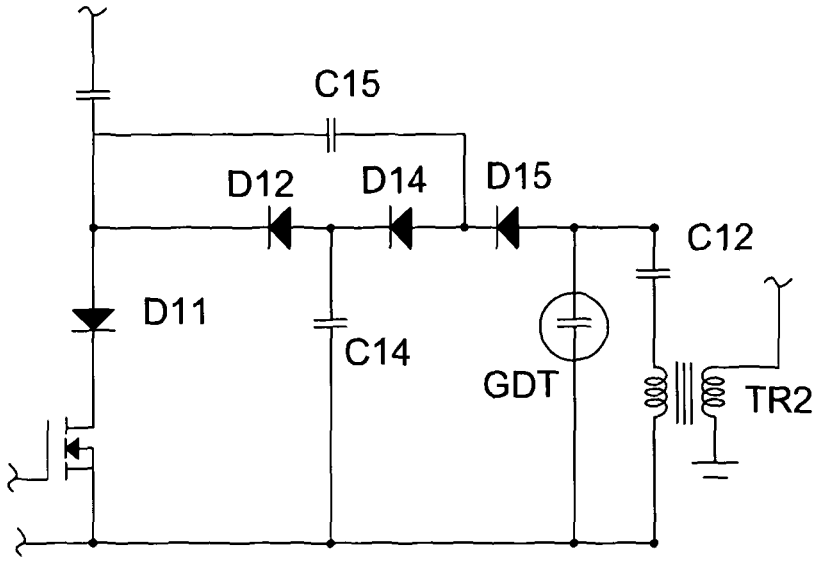
FIG. 3 is a scrap view of a variation of the diagram of FIG. 1.

Turning to the variant of FIG. 3, the arrangement of the discharge capacitor C11 and the gas discharge tube GTD is interchanged. They operate in an analogous way to that in which they operate in FIG. 2. The variant also includes a voltage doubler stage comprising diodes D14, D15 and capacitors C14, C15. With this arrangement, including an appropriate value GDT, doubled primary voltage is applied to the transformer TR2.

The invention claimed is:

1. A magnetron powered lamp comprising:
- a Microwave Plasma tight Source (MPLS);
- a magnetron arranged to power the MPLS;
- a Magnetron, Switched Converter Power Circuit (MSCPC) arranged to power the magnetron;
- a microprocessor arranged to control the MSCPC;
- a starter for starting a plasma in the fill in a closed void of the MPLS, the starter comprising:
  - a starter electrode arranged to apply starter voltage to the closed void;
  - a starter circuit including;
    - a capacitor;
    - means for selectively charging the capacitor from a switched point in the MSCPC;
    - means for discharging the capacitor;
    - a transformer having:
      - a primary winding arranged to receive discharge current from the capacitor and
      - a secondary winding arranged to generate the starter voltage, the secondary winding being connected to the starter electrode for application of starter voltage to the closed void and
    - a detector for detecting starting of the plasma; wherein:
  - the microprocessor is arranged to select charging of the capacitor for starting of the plasma until the detector detect the plasma has started.

2. The magnetron powered lamp as claimed in claim 1, wherein the selective charging means is an electronic switch normally isolating the discharging means from the switched point of the power circuit.

3. The magnetron powered lamp as claimed in claim 1, wherein the selective charging means is an electronic switch normally grounding the discharge means.

4. The magnetron powered lamp as claimed in claim 2, wherein the electronic switch is a transistor and the means for discharging the capacitor is a gas discharge unit.

5. The magnetron powered lamp as claimed in claim 2, wherein the electronic switch is a transistor and the means for discharging the capacitor is a trigger diode.

6. The magnetron powered lamp as claimed in claim 1, wherein the microprocessor controls the MSCPC via an integrated circuit arranged in a feed back loop and adapted to apply a control signal to a converter switching circuit in accordance with a comparison of a signal from means for measuring MSCPC with a signal from the microprocessor for controlling the power of the magnetron to a desired power.

* * * * *